United States Patent [19]

Weichselgartner

[11] Patent Number: 4,490,288

[45] Date of Patent: Dec. 25, 1984

[54] METHOD AND SYSTEM FOR REMOVING TRITIUM FROM A GAS MIXTURE

[75] Inventor: Heinrich Weichselgartner, Munich, Fed. Rep. of Germany

[73] Assignee: Max-Planck-Gesellschaft zur Foerderung der Wissenschaften e.V., Goettingen, Fed. Rep. of Germany

[21] Appl. No.: 280,874

[22] Filed: Jul. 6, 1981

[30] Foreign Application Priority Data

Jul. 4, 1980 [DE] Fed. Rep. of Germany ..... 3025494

[51] Int. Cl.[3] ..... G21F 9/02

[52] U.S. Cl. ..... 252/630

[58] Field of Search ..... 252/630

[56] References Cited

U.S. PATENT DOCUMENTS

| | | | |
|---|---|---|---|
| 3,147,243 | 9/1964 | Brindell et al. | 252/646 |
| 4,020,003 | 4/1977 | Steinberg et al. | 252/628 |
| 4,178,350 | 12/1979 | Collins et al. | 252/630 |

OTHER PUBLICATIONS

Gilmore, Ed., *Radioactive Waste Disposal: Low and High Level,* Noyes Data Corp., New Jersey (1977), pp. 159–164.

Tosetti, "Gaseous Waste Treatment" in Moghissi et al., Eds., *Nuclear Power Waste Technology,* Am. Soc. Mech. Engr., N.Y. (1978), pp. 201–209.

Dutton et al., "Reaction of Unsaturated Organic Compounds with Tritium Gas" Chem. Abs., vol. 59 (1963), #2620a.

Inspec, Engineering Design Study of a Reference Theta-Pinch Reactor, F. L. Ribe et al., 99, 138 and 139.

Bulletin of the Chemical Society of Japan, vol. 34 (1961), pp. 167–169.

*Primary Examiner*—Brooks H. Hunt

*Attorney, Agent, or Firm*—Brumbaugh, Graves, Donohue & Raymond

[57] ABSTRACT

A method and an apparatus for removing tritium from a gas mixture containing trace amounts of tritium as contamination are provided. The gas mixture is passed through a hydrogenating material of unsaturated carboxylic acid to remove the contaminating tritium by a hydrogenation reaction.

5 Claims, 1 Drawing Figure

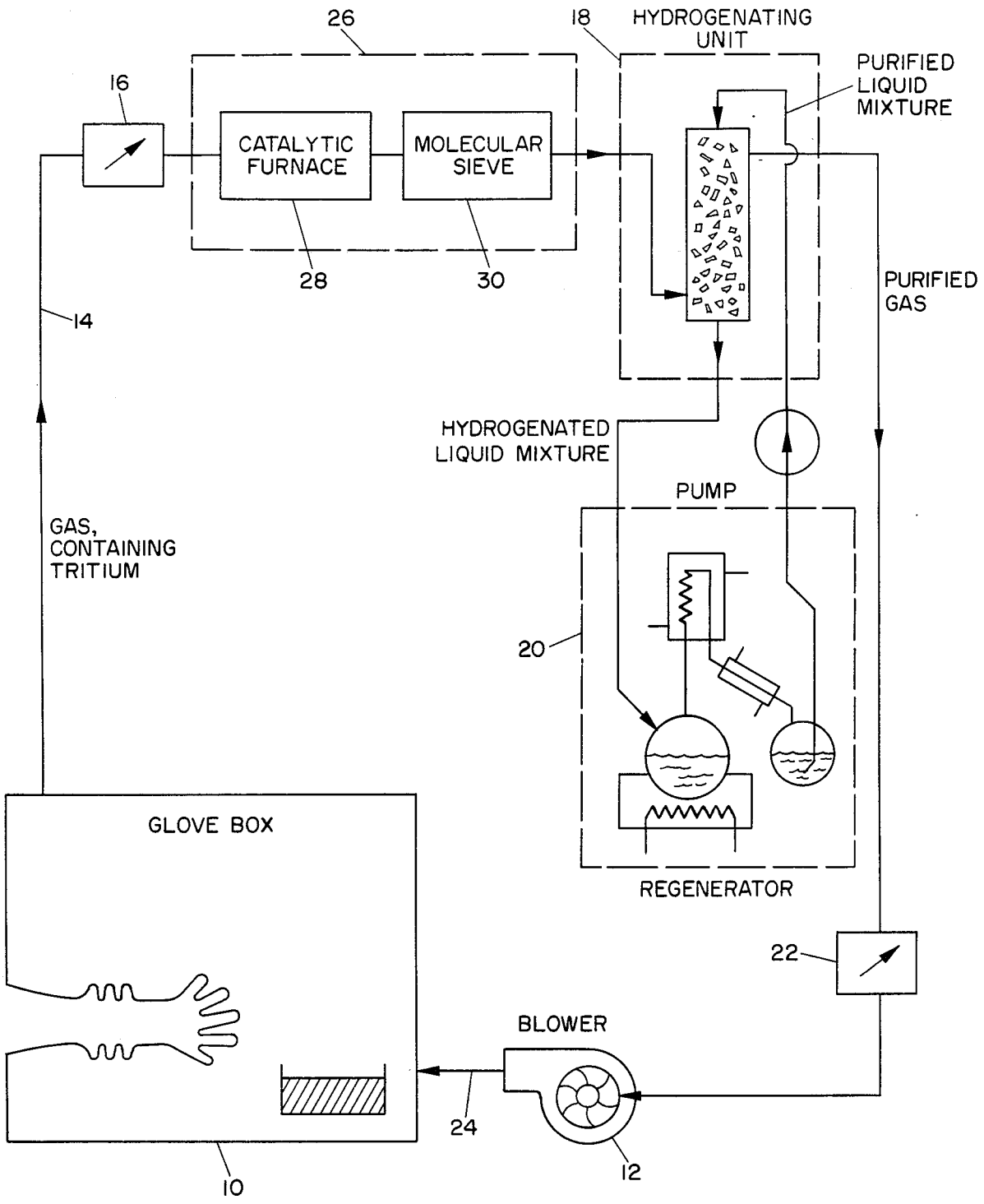
26
18
HYDROGENATING UNIT
PURIFIED LIQUID MIXTURE
16
CATALYTIC FURNACE
MOLECULAR SIEVE
28
30
14
PURIFIED GAS
HYDROGENATED LIQUID MIXTURE
PUMP
GAS, CONTAINING TRITIUM
20
GLOVE BOX
REGENERATOR
22
BLOWER
24
12
10

METHOD AND SYSTEM FOR REMOVING TRITIUM FROM A GAS MIXTURE

BACKGROUND OF THE INVENTION

1. Field to which the invention relates:

The present invention relates to methods and systems for removing tritium from a gas, as air.

2. The prior art:

In many nuclear- and plasma-physical experiments and work, gaseous tritium ($T_2$) is produced. Since this is known to be radioactive and, thus, a health hazard, generally it must be removed from the atmosphere in the relevant work-area or the like.

It is known to withdraw tritium-containing air out of work areas, glove-boxes, or the like by means of a blower, and to convert the tritium, with oxygen, into tritium-containing water in a catalytic furnace which may contain CuO, Pd or Pt as a catalyst. The resulting water is then absorbed in a molecular sieve. Conventional modern tritium-separating systems contain, in addition to the catalytic furnace and the molecular-sieve, which are the main components, also heating devices, cooling devices, heat-exchangers and the like.

It is possible in this way to achieve a final concentration of some $10^{-5}$ Ci per cubic metre of air. In practice, however, one must often be content with some $10^{-4}$ Ci/m$^3$.

The factors governing the minimal obtainable tritium concentration in the purified air are still largely uncertain. The partial water-vapour pressure in the molecular sieve, and the yield from catalytic oxidation, are assumed to be important. Even with a 1% loading of a molecular sieve, the partial water-vapour pressure at 20° C. for optimum performance amounts to about $10^{-7}$ torrs which corresponds in relation to THO to a tritium activity of $2.10^{-4}$ Ci/m$^3$ of air. This immediately indicates a serious disadvantage of modern purification technology: since the humidity in the ambient air is absorbed from the molecular sieves simultaneously with the tritium-containing water the loading limit of the molecular sieves (about 1%) is soon reached. The molecular-sieve columns must therefore either be made correspondingly large or must be frequently regenerated, and this leads to large quantities of contaminated water. With incomplete catalytic oxidation of the tritium into water, gaseous tritium remains. This passes unimpeded through the molecular sieves and is thus present as an inadmissible output-air activity.

Attempts have been made to eliminate the disadvantages of the above-mentioned methods by cooling the molecular sieves with liquid nitrogen and with novel noble-metal catalysts, but the results have not been satisfactory.

SHORT SUMMARY OF THE INVENTION

An object of the present invention is to provide a method and an apparatus by means of which tritium may be more completely removed from a gas mixture than has hitherto been possible.

According to the invention, this purpose is achieved in that the tritium is subjected to a hydrogenation-reaction.

According to the invention, therefore, the known oxidizing process, whereby tritium is oxidized to water, is replaced or extended by a reducing or hydrogenating process which delivers an easily separable, liquid or solid reaction-product. In this connection, conversion of the tritium with oxygen to water is not included in the terms reducing or hydrogenating process.

Hydrogen and therefore also tritium, especially in the atomic form, reacts more or less easily with other atoms or molecules, especially with unsaturated hydrocarbon compounds. Suitable and proven hydrogenation reactions are the hydrogenation of carbon and petroleum, fat hardening (hydrogenating oily fats to solid fats), the addition of hydrogen on double or triple bonds (e.g. the conversion of benzene into cyclohexane, or of naphthaline into decaline and tetraline), the reduction of aldehydes and ketones to alcohols, and of nitriles and nitro-compounds to amines.

Heavy petroleum fractions may be converted by so-called "hydrocracking" into products with low boiling ranges. The process is carried out at moderate temperatures and pressures in the presence of noble metal catalysts. The use of 100 parts by weight of heavy vacuum gas oil and 3 parts by weight of hydrogen produces, for example, after one passage:

3.2 parts by weight $NH_3+H_2S$,
2.5 parts by weight $C_1$—to $C_3$—fractions,
3.6 parts by weight $C_4$—fraction,
8.7 parts by weight $C_5$—and $C_6$—fractions,
14.8 parts by weight $C_7$—fraction, and
70.3 parts by weight of a high-boiling fraction (according to: READ, D, C. H. Watkins and J. G. Eckhouse; Oil Gas J. 63, 86 (24.5.1965).

It is thus possible, in principle, to control hydrogenation in such a manner that that longer-chain hydrocarbons are converted into shorter-chain hydrocarbons. As will be explained hereinafter in more detail, this is a particular advantage of the method according to the invention. It is highly advantageous to remove tritium from a gas-mixture by hydrogenation of unsaturated organic compounds, more particulary unsaturated carboxylic acids. It is particularly advantageous to use unsaturated monocarboxylic acids, in which case the hydrogenation is preferably carried out catalytically. It is preferable to use unsaturated fatty acids, especially those containing between 5 and 20 C atoms. For example, linolenic acid ($C_{17}H_{29}$—COOH) has three double bonds:

$$CH_3—CH_2—CH{=}CH—CH_2—CH{=}CH—CH_2—CH{=}CH—(CH_2)_7.\ COOH$$

and linoleic acid $C_{17}H_{31}$—COOH has two:

$$CH_3—(CH_2)_4—CH{=}CH—CH_2—CH{=}CH—(CH_2)_7—COOH$$

Upon hydrogenation, both are converted to stearic acid ($CH_3—(CH_2)_{16}$—COOH, If the unsaturated monocarboxylic acids are hydrogenated with tritium, the tritium is firmly bonded in the stearic acid, i.e. one or more of the $CH_2$ groups contains T instead of H.

The hydrogenation process may be controlled in such a manner that the tritiated stearic acid is split up, by incorporation of the tritium, into fractions having shorter chain-lengths, and physical properties other than the long-chain $C_{17}$ fatty acids. This has the major advantage that the tritium-containing reaction-product, because of differences in solubility, density, melting point and boiling point, can be separated continuously or intermittently from the compounds not reacted with tritium and may be removed from the hydrogenation product. A fresh reaction partner is therefore always available for hydrogenation and only relatively small amounts of tritium-containing, radioactive reaction-products are produced.

The hydrogenating device, or column, may be in the form of a fixed bed, a fluidized bed, a liquid column, or an emulsion column.

The method and apparatus according to the invention are well suitable for cleaning the exhaust air from workshops and for circulatory cleaning of closed systems such as inert-gas glove-boxes. In the case of inertgas glove-boxes there is the advantage that autoxidation of the preferably used unsaturated fatty acids cannot take place because of the absence of any atmospheric oxygen, and the efficiency cannot therefore be reduced (no high "idle consumption" of unsaturated fatty-acids, no resinification, etc.).

If an apparatus, operating according to the method of the invention, is used as an emergency or safety-system, all conceivable disadvantages (autoxidation, decomposition of compounds) will be minimized, since the comparatively low costs of the chemicals used are immaterial.

The invention provides the following advantages:

Conventional systems will always depend upon the efficiency of the oxidizing reaction and unconverted $T_2$ gas leaves known installations unimpeded. Particularly in areas of high atmospheric humidity, the maximal permissible loading of the molecular sieves will rapidly be exceeded. Residual-gas activity then increases rapidly.

These disadvantages are essentially avoided by the method according to the invention. Especially if the conventional oxidizing process is combined with the reducing or hydrogenating process according to the invention, both tritium-containing water and $T_2$ are very largely eliminated from purified gas-mixtures. In case of an emergency system, the method according to the invention provides the particular advantage that "breakthrough concentrations" (>1% concentration of water-vapour) at the molecular sieve, and therefore activities above $10^{-5}$ Ci/m$^3$, cannot arise. With the method acording to the invention, continuous replacement of the consumed reaction-partners (hydrogenated fatty acids), and thus continuous operation, is possible, no regeneration pauses are necessary, and the activity cannot therefore rise.

In inert-gas containments also very low concentrations of the T can be eliminates continuously.

The DRAWING shows, by way of example and diagrammatically an embodiment of a system according to the invention. The apparatus is designed to purify the atmosphere in an enclosed work-area 10 in the form of a so-called "glove-box". The atmosphere in closed area 10 is circulated by means of a blower. Gas from area 10 flows through an outlet line 14, an activity-measuring unit 16, a hydrogenating unit 18 connected to a regenerator 20, through a further activity-measuring unit 22 and, finally, through blower 12, and a return line 24, back to area 10. The atmosphere in area 10 may consist of an inert gas, more particularly a noble gas such as argon. Hydrogenating unit 18 may contain a fluidized bed, a fixed bed, a solution-column or an emulsion-column. The hydrogenating unit preferably contains an unsaturated fatty acid, and the said regenerator is used to separate tritium-containing reaction products.

If the atmosphere in area 10 contains oxygen and consists of air, for example, hydrogenating unit 18 may also be preceded by a known oxidizing unit 26 which contains a catalytic furnace 28 and a molecular-sieve column 30 and which is otherwise of known design.

In a preferred embodiment of the invention, the hydrogenating unit 18 is comprised of a column filled with know packing internals, as Intalox saddle bodies. A liquid mixture, comprising in proportional amounts 40 parts by volume linoleic acid (95%)

10 parts by volume linolenic acid (70%)

1 gram palladium acetonylacetate (hydrating catalyst)

is fed to the top of the column. The gas to be purified is fed to the bottom of the column, and the purified gas is withdrawn from the top of the column. The liquid mixture which may comprise solved stearic acid formed by hydration with tritium, is withdrawn from the bottom of the column, and passed through the regenerator which may comprise a fractionating column of known type. The purified liquid mixture, from which the tritium-containing stearic acid has been removed is recirculated to the purifying column.

The following test shows the effectiveness of this process:

40 milliliters linoleic acid (95%)

10 milliliters linolenic acid (70%) and 1 gram palladium acetonylacetate were placed in a glass vessel having a volume of 250 milliliters. The remaining volume of the vessel was filled with helium comprising tritium in a proportion to obtain an initial activity of $1.25\times10^{-5}$ Curies per milliliter. The vessel was shaken to secure intimate gas-liquid contact. Samples of 50 microliters were withdrawn from the vessel in regular intervals of about 5 minutes, and the tritium concentration was measured in a liquid scintillator measuring device. The activity of the acid mixture rose continuously and more than 95 percent of the initial activity was found in the acid mixture already after 30 minutes. After 3 hours, the tritium concentration of the liquid samples leveled off at a saturation value corresponding, within the accuracy of measurement, to a tritium content of 2.5 millicuries. Simultaneous by, a plurality of samples were obtained from the gas volume and investigated: The average value of the tritium concentration found was $3\times10^{-7}$ Ci/ml. Thus, essentially all of the available tritium was taken up by the acid mixture, and the radioactivity of the gas was reduced to about one percent of its initial value.

The invention has been described by way of illustration rather then limitation, and varions modifications will occur to those skilled in the art within the scope of the invention.

I claim:

1. A method for rapidly removing essentially all of the tritium from a gas mixture, which mixture comprises trace amounts of tritium as contamination, and is contained in an enclosed space, sealed from the atmosphere, said method comprising the steps of (a) removing the gas mixture from said space;

(b) passing said gas mixture by means of a blower through a hydrogenating material, comprising an unsaturated carboxylic acid, to remove said contaminating tritium by a hydrogenation reaction with said carboxylic acid; and (c) recirculating the gas obtained from step (b) to said space.

2. The method according to claim 1, which further comprises the step of passing the removed gas mixture from step (a) through an apparatus which converts a given amount of the tritium gas mixture to tritium-containing water, and which separates said water from the remaining tritium gas mixture.

3. The method according to claim 1, wherein the unsaturated carboxylic acid is a polyunsaturated monocarboxylic acid.

4. The method according to claim 3, wherein the polyunsaturated monocarboxylic acid is selected from the group consisting of linoleic acid and linolenic acid.

5. The method according to claim 1, which further comprises adding a catalyst to the hydrogenation reaction.

* * * * *